US006150641A

United States Patent [19]

Wilkins

[11] Patent Number: 6,150,641

[45] Date of Patent: Nov. 21, 2000

[54] TEMPERATURE SENSING AND LIMITING DEVICE

[75] Inventor: Peter Ravenscroft Wilkins, Droitwich, United Kingdom

[73] Assignee: Ceramaspeed Limited, United Kingdom

[21] Appl. No.: 09/262,540

[22] Filed: Mar. 4, 1999

[30] Foreign Application Priority Data

Mar. 20, 1998 [GB] United Kingdom ..... 9805852

[51] Int. Cl.[7] ..... H05B 1/02

[52] U.S. Cl. ..... 219/512; 219/494; 219/449; 219/505; 337/333

[58] Field of Search ..... 219/497, 481, 219/494, 443–453, 505, 506, 512; 337/390, 391, 392, 395, 333; 307/117

[56] References Cited

U.S. PATENT DOCUMENTS

| | | |
|---|---|---|
| 3,805,022 | 4/1974 | Kulwicki et al. . |
| 4,447,710 | 5/1984 | McWilliams . |
| 4,577,176 | 3/1986 | Bayer . |
| 4,723,067 | 2/1988 | Schreder ..... 219/450 |
| 5,489,764 | 2/1996 | Mannuss et al. . |

FOREIGN PATENT DOCUMENTS

| | | |
|---|---|---|
| 0157277 | 10/1985 | European Pat. Off. . |
| 3720720 | 1/1989 | Germany . |
| 2025141 | 1/1980 | United Kingdom . |
| 2038550 | 7/1980 | United Kingdom . |
| 2276783 | 10/1994 | United Kingdom . |
| 2290415 | 12/1995 | United Kingdom . |

*Primary Examiner*—Mark Paschall
*Attorney, Agent, or Firm*—Ira S. Dorman

[57] ABSTRACT

A temperature sensing and limiting device is described for use in a radiant electric heater (8) incorporating at least one heating element (14). The device comprises an elongate tubular housing (1) adapted to at least partly traverse the heater so as to be heated externally by the heating element. A component (4) is provided within the housing and provides an electrical parameter which changes as a function of temperature. At least a thermal-sensing portion (11) of a thermally-responsive bimetallic cut-out device (10) is provided within the housing (1), the cut-out device being adapted to deenergize the heater (8) at a predetermined temperature.

18 Claims, 3 Drawing Sheets

TEMPERATURE SENSING AND LIMITING DEVICE

This invention relates to the sensing and limiting of temperature in a radiant electric heater, such as for example in a cooking appliance, particularly a glass-ceramic cooking appliance.

DESCRIPTION OF PRIOR ART

It has been well-known for many years to provide heaters in glass-ceramic cooking appliances with temperature limiting devices arranged to sense the temperature particularly of the glass-ceramic cooking surface and to deenergise the heaters at a predetermined temperature to prevent overheating of the glass-ceramic. Such temperature limiting devices commonly comprise a differentially-expanding rod-in-tube assembly having one end thereof arranged to activate mechanical switch means. Such devices are restricted in operation to one predetermined temperature and exhibit a significant tolerance (typically ±5%) deviating about this predetermined temperature, as a result of variations of manufactured components and limitations of assembly processes.

There are increasing requirements for improved accuracy and greater flexibility of control of radiant heaters and particularly to provide dynamic sensing and control of temperature. Improved accuracy, to typically ±1%, means that the nominal glass-ceramic temperature can be set higher and maintained within an acceptable range even at upper specified limits (top tolerance), thereby meeting the requirements recommended by manufacturers of the glass-ceramic material for maximum temperature and power load characteristics. The ability to operate at a higher temperature for the glass-ceramic cooking surface leads to improved boiling performance especially with high power heaters and poor quality cooking utensils. This is leading to the replacement of conventional thermal limiting devices by temperature sensing devices, for example temperature-sensitive resistance devices such as platinum resistance temperature detectors and the use of microprocessor-based circuits.

A problem with the use of such devices is that, unlike the temperature limiting devices of the prior art, they do not provide a fail-safe function and in the event of failure of the associated electronic circuitry overheating of the glass-ceramic may occur, which is dangerous and may result in failure to meet electrical safety legislation.

It has therefore been considered essential to provide an additional mechanical thermal switch in the heater as a safety cut-out device. Although this solves the problem, the resultant plurality of components is undesirable and inconvenient for manufacture of the heaters.

OBJECT OF THE INVENTION

It is an object of the present invention to overcome this disadvantage.

SUMMARY OF THE INVENTION

The present invention provides a temperature sensing and limiting device for use in a radiant electric heater incorporating at least one heating element, the device comprising an elongate tubular housing adapted to at least partly traverse the heater so as to be heated externally by the heating element; a component provided within the housing and providing an electrical parameter which changes as a function of temperature; and at least a thermal-sensing portion of a thermally-responsive bimetallic cut-out device provided within the housing, the cut-out device being adapted to deenergise the heater at a predetermined temperature.

The component and/or the bimetallic cut-out device may be in thermo-conducting relationship with the housing.

The bimetallic cut-out device, or portion thereof, may be accommodated in the tubular housing at an end region thereof, which may be arranged for location at a peripheral region of the heater.

The component providing an electrical parameter which changes as a function of temperature may be accommodated in the tubular housing remote from the bimetallic cut-out device, or portion thereof, such as at an opposite end region of the tubular housing thereto.

The tubular housing may comprise one or more component parts and may have a portion accommodating the bimetallic cut-out device, or portion thereof, which is wider than that portion accommodating the component.

The housing may comprise a metal or a ceramic, or a combination of a metal and a ceramic.

The component may comprise a temperature-sensitive resistor, capacitor or inductor, or a thermo-electric device, such as a thermocouple and the electrical parameter which changes as a function of temperature may be resistance, capacitance, inductance or voltage or current.

In particular, the component may comprise a platinum resistance temperature detector.

Means, such as electrical terminals and/or leads may be provided for connecting the component to an evaluating circuit such as for control of the heater and for enabling the bimetallic cut-out device to be connected in circuit with the heater and a power supply.

The arrangement of the invention provides a temperature sensing component and bimetallic safety cut-out device as a compact, integrated unit, which is readily secured to a radiant electric heater for operation and results in simplified mechanical and electrical connections.

The invention is now described by way of example with reference to the accompanying drawings, in which:

DESCRIPTION OF PREFERRED EMBODIMENT

Figure 1:
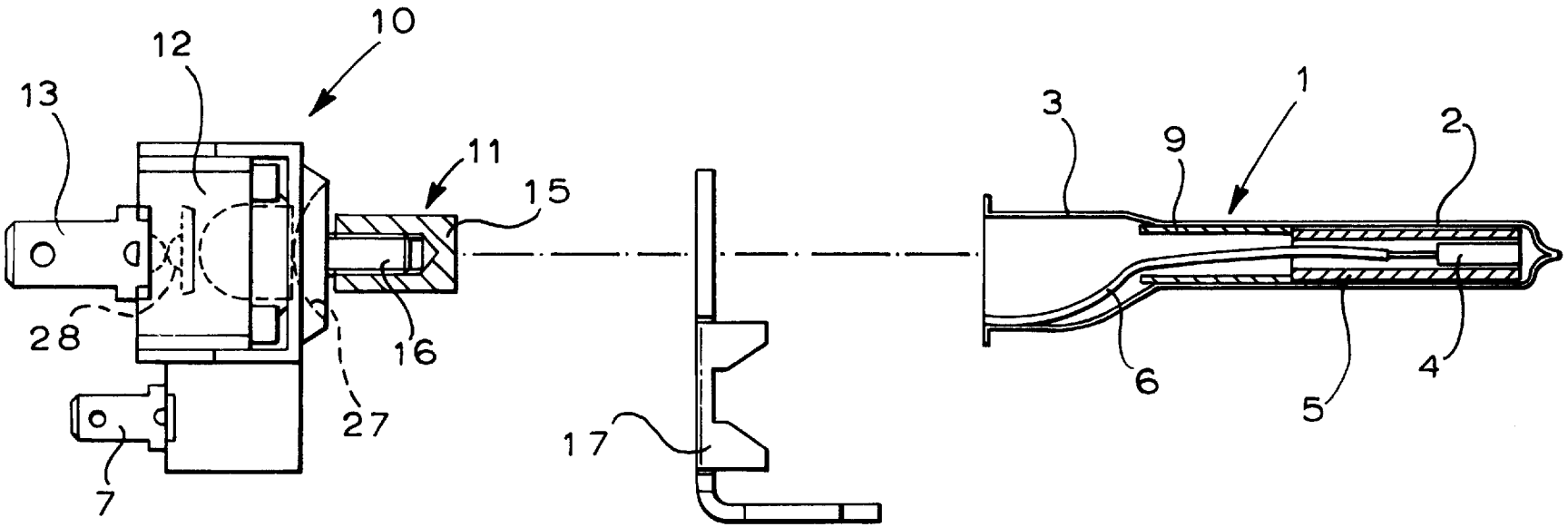
FIG. 1 is an exploded, part-sectional view of a temperature sensing and limiting device according to the invention.

A temperature sensing and limiting device for a radiant electric heater, particularly for a glass-ceramic cooking appliance, has a housing comprising an elongate tubular member 1. The tubular member 1, comprises a metal such as stainless steel, but could comprise another suitably high temperature withstanding material, such as a ceramic. The tubular member 1 has a relatively narrow portion 2, which may be closed at its end if required, and a wider opposite end portion 3.

Inserted in the tubular member 1 at the narrow end portion 2 is a temperature-sensing component 4 providing an electrical parameter which changes as a function of temperature.

This component may comprise a platinum resistance temperature detector, whose electrical resistance changes as a function of temperature. However it could comprise another resistance device having either PTC or NTC characteristics or could comprise a capacitor or an inductor, or a thermoelectric device such as a thermocouple. In addition to electrical resistance, the electrical parameter which changes as a function of temperature could be capacitance, inductance, voltage or current, according to the type of temperature-sensing component employed as the component 4.

The component 4 is fitted inside a ceramic tube 5, such as of alumina, which is a sliding fit inside the narrow portion 2 of the tubular member 1. As a result, the component 4 is in good thermo-conducting relationship with the tubular member 1.

Figure 4:
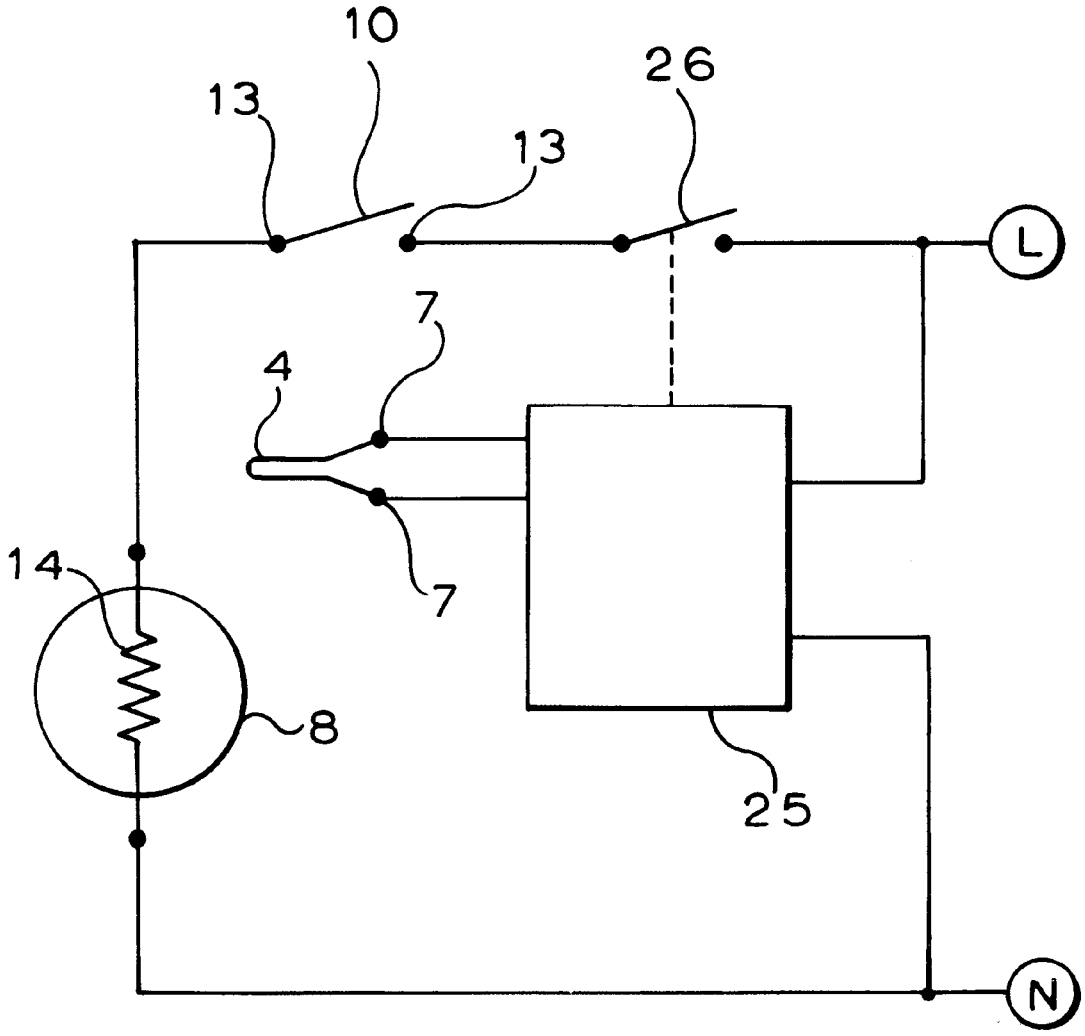
FIG. 4 is a circuit diagram illustrating the temperature sensing and limiting device in an electrical circuit with a radiant electric heater.

Lead wires 6, provided with braided glass insulation, are connected to terminals 7 which enable the component 4 to be electrically connected to an appropriate evaluating circuit 25 of known form for sensing and providing control of the temperature of a heater 8 (FIG. 2) by way of a switch 26 (FIG. 4). An electrically insulating sleeve 9, such as of braided glass fibres, may also be provided inside the tubular member 1.

A thermally-responsive bimetallic cut-out device 10 has a thermal-sensing stub portion 11 inserted in the wide end portion 3 of the tubular member 1 and arranged such that the stub portion 11 is in good thermo-conducting relationship with the tubular member 1. The stub portion 11 thermally communicates with a well-known arrangement of bimetallic disc 27 and switch contacts 28 accommodated in an enclosure 12 (shown in detail in FIG. 1). At a predetermined temperature sensed by the stub portion 11, the bimetallic disc 27 deflects and breaks the associated switch contacts 28. At a predetermined lower temperature, the disc automatically re-deflects to its former position, remaking the switch contacts. Such construction and operation of a bimetallic cut-out switch is known to the skilled person, the bimetallic component comprising two layers of material, such as metal, bonded together, the two materials having different thermal expansion characteristics so as to cause the bimetallic component to deform when heated.

Figure 2:
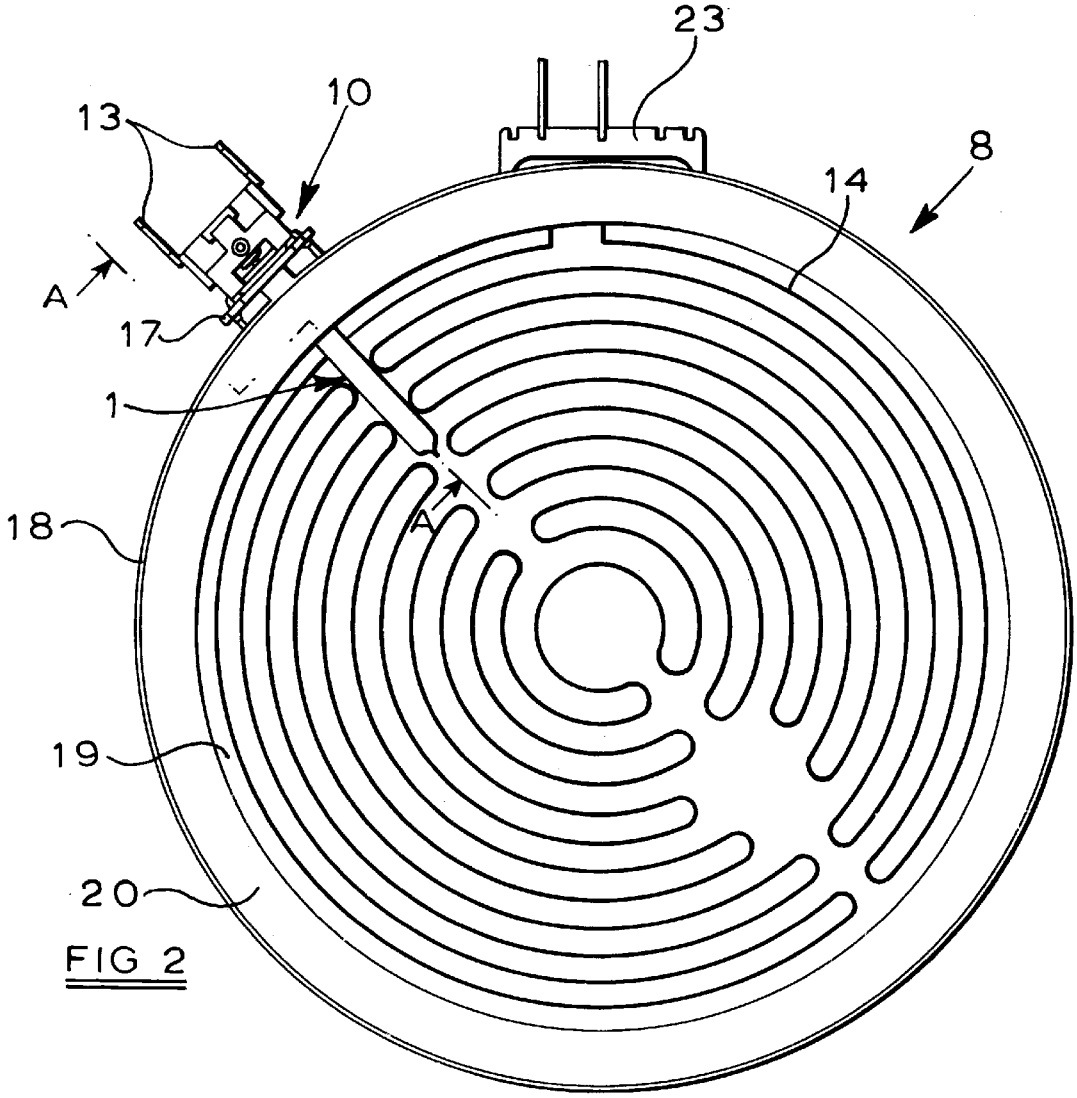
FIG. 2 is a plan view of a radiant electric heater provided with the device of FIG. 1.

The switch contacts 28 of the bimetallic cut-out device 10 are electrically connected to terminals 13 provided on the enclosure 12 and by means of which the cut-out is able to be connected between a power supply (illustrated by the terminals L and N in FIG. 4) and a heating element 14 (FIG. 2) in the radiant heater 8 (FIG. 2).

The stub portion 11 of the bimetallic cut-out device 10 comprises a bushing 15 of good thermally conducting material, such as steel, aluminium, copper or brass, tightly fitting over a part 16, also of good thermally conducting material, which thermally communicates with the bimetallic switch components in the enclosure 12.

The bushing 15 and associated part 16 may comprise the same, or different, materials and could be replaced by a single equivalent part if required.

The resulting temperature sensing and limiting device is provided with a metal mounting bracket 17 by means of which it is secured to a metal dish-like support 18 (FIG. 3) of the radiant heater 8 by means of a threaded fastener 24.

Figure 3:
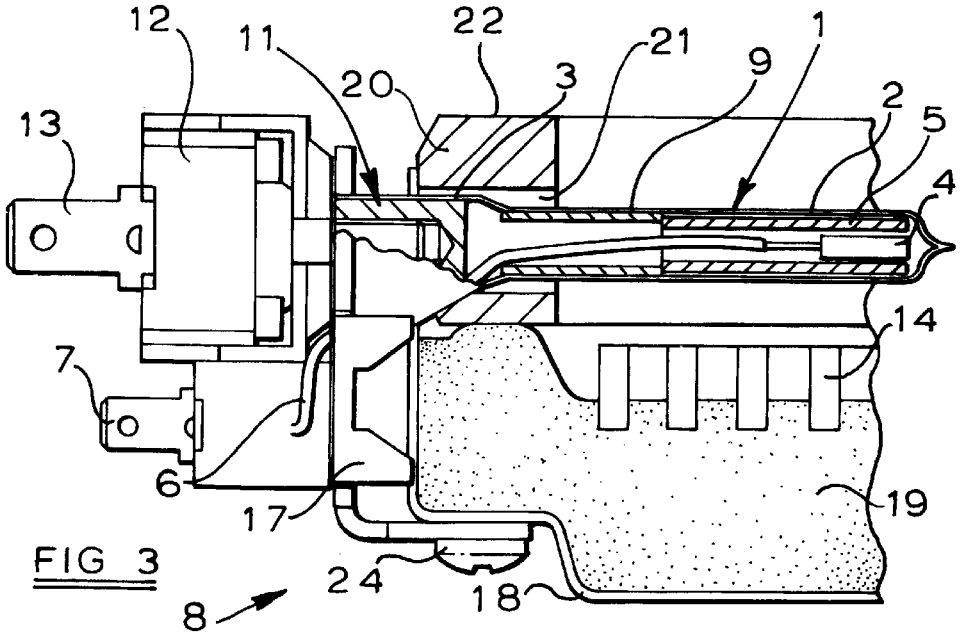
FIG. 3 is a part-sectional view along line A—A of a detail of the heater of FIG. 2.

As shown in FIGS. 2 and 3, the radiant heater 8 comprises a base layer 19 of thermal and electrical insulation material, such as microporous insulation material, provided in the dish-like support 18. At least one heating element 14, such as of well-known wire or ribbon form, is supported on the base layer 19. A wall 20 of insulation material surrounds the heater at the periphery thereof and has an aperture 21 through which the tubular member 1 of the temperature sensing and limiting device of the invention passes. An upper surface 22 of the peripheral wall is arranged to contact the rear side of a glass-ceramic sheet (not shown), such as for a cooking surface, the tubular member 1 of the device being located spaced between the heating element 14 and the sheet of glass-ceramic.

A terminal block 23 is provided for connecting the heater to a power supply for operation.

When the heater is operated, the temperature-sensitive component 4, connected to its associated evaluating circuit by means of the terminals 7, monitors the temperature. The evaluating circuit 25, which is preferably microprocessor-based, controls operation of the heating element 14 and enables accurate control of the temperature of the glass-ceramic to be achieved. Such accuracy may be typically to ±1% of a predetermined temperature value.

The bimetallic cut-out device 10 is electrically connected between the power supply and the heating element 14 and independently of the component 4 and its associated evaluating circuit 25. If for any reason the heater 8 is operated, for example as a result of malfunction or failure of the component 4 or its associated evaluating circuit 25, such that an undesirably high temperature is reached, damage to the glass-ceramic is avoided by the bimetallic cut-out device 10 responding to the temperature and operating to break the circuit to the heater. The heating element 14 is thereby safely de-energised. When the heater cools down, the bimetallic cut-out device 10 automatically operates to reconnect the heater to the power supply.

What is claimed is:

1. A temperature sensing and limiting device for use in a radiant electric heater incorporating at least one heating element, the device comprising an elongate tubular housing adapted to at least partly traverse the heater so as to be heated externally by the heating element; a temperature-sensing component provided within the housing and providing an electrical parameter which changes as a function of temperature; and a thermally-responsive bimetallic cut-out device adapted to deenergise the heater at a predetermined first temperature, at least a thermal-sensing portion of the cut-out device being provided within the tubular housing.

2. A device according to claim 1, wherein at least one of the component and the bimetallic cut-out device is in thermo-conducting relationship with the housing.

3. A device according to claim 1, wherein at least the thermal-sensing portion of the bimetallic cut-out device is accommodated in the tubular housing at an end region thereof.

4. A device according to claim 3, wherein the end region is arranged for location at a peripheral region of the heater.

5. A device according to claim 3, wherein the component providing an electrical parameter which changes as a function of temperature is accommodated in the tubular housing remote from the thermal-sensing portion of the bimetallic cut-out device.

6. A device according to claim 5, wherein the component is accommodated in the tubular housing at an opposite end region to that at which the thermal-sensing portion of the bimetallic cut-out device is accommodated.

7. A device according to claim 1, wherein the tubular housing comprises at least one component part.

8. A device according to claim 7, wherein the tubular housing has a portion accommodating at least the thermal-sensing portion of the bimetallic cut-out device which is wider than that portion accommodating the component.

9. A device according to claim 1, wherein the housing comprises a material selected from a metal, a ceramic, and a combination of a metal and a ceramic.

10. A device according to claim 1, wherein the component is selected from a temperature-sensitive resistor, a temperature-sensitive capacitor, a temperature-sensitive inductor, and a thermo-electric device.

11. A device according to claim 10, wherein the electrical parameter which changes as a function of temperature is selected from resistance, capacitance, inductance, voltage and current.

12. A device according to claim 10, wherein the thermo-electric device comprises a thermocouple.

13. A device according to claim 10, wherein the component comprises a platinum resistance temperature detector.

14. A device according to claim 1, wherein connecting means are provided for connecting the component to an evaluating circuit and for enabling the bimetallic cut-out device to be connected in circuit with the heater and a power supply.

15. A device according to claim 14, wherein the evaluating circuit is for control of the heater.

16. A device according to claim 14, wherein the connecting means comprise at least one of electrical terminals and leads.

17. A radiant electric heater provided with a temperature sensing and limiting device according claim 1.

18. A device according to claim 1 wherein the bimetallic cut-out device is further adapted to energise the heater at a predetermined second temperature lower than the predetermined first temperature.

* * * * *